US010119262B2

(12) United States Patent
Prior

(10) Patent No.: US 10,119,262 B2
(45) Date of Patent: Nov. 6, 2018

(54) HEIGHT ADJUSTABLE TOILET PLATFORM

(71) Applicant: Dignity LC Services Ltd, Biggleswade (GB)

(72) Inventor: Darren Michael Prior, Hitchin (GB)

(73) Assignee: Dignity LC Services Ltd (GB)

( * ) Notice: Subject to any disclaimer, the term of this patent is extended or adjusted under 35 U.S.C. 154(b) by 0 days.

(21) Appl. No.: 15/344,559

(22) Filed: Nov. 6, 2016

(65) Prior Publication Data

US 2017/0130441 A1 May 11, 2017

(30) Foreign Application Priority Data

Nov. 6, 2015 (GB) ..... 1519623.1
Nov. 4, 2016 (GB) ..... 1618607.4

(51) Int. Cl.
*E03D 11/00* (2006.01)
*E03D 11/12* (2006.01)
*E03D 11/16* (2006.01)

(52) U.S. Cl.
CPC ..... *E03D 11/125* (2013.01); *E03D 11/16* (2013.01)

(58) Field of Classification Search
CPC ..... E03D 11/125; E03D 11/16; E03D 11/135; E03D 11/143
USPC ..... 4/420, 667, 252.1, 645, 564.1
See application file for complete search history.

(56) References Cited

U.S. PATENT DOCUMENTS 4,091,473 A * 5/1978 Matthews ..... E03D 11/125 4/300
4,726,079 A * 2/1988 Signori ..... A47K 13/10 4/252.1
5,031,251 A * 7/1991 Williams ..... E03C 1/324 297/330
5,199,113 A * 4/1993 Glasow ..... E03C 1/324 192/129 R
5,432,957 A * 7/1995 Fernie ..... E03D 11/16 4/252.1
5,694,864 A * 12/1997 Langewellpott ..... B66F 7/0608 108/145
8,196,233 B1 * 6/2012 Daniels ..... E03D 11/16 4/252.1
8,336,130 B1 * 12/2012 Cardenas ..... E03D 11/125 4/252.1

(Continued)

FOREIGN PATENT DOCUMENTS

JP 03072126 A * 3/1991
JP 06185103 A * 7/1994
JP 2014-70431 4/2014

OTHER PUBLICATIONS

JP03072126—English Translation—Machine Generated, Oct. 2017.*

*Primary Examiner* — Benjamin R Shaw

(74) *Attorney, Agent, or Firm* — Merek, Blackmon & Voorhees, LLC

(57) ABSTRACT

A platform for supporting a toilet bowl, and more preferably a height adjustable platform for supporting a toilet bowl is disclosed. The platform comprises principally of a planar base member for engaging a ground surface, a planar top member for attachment to a toilet bowl, and a plurality of support members extending between the base member and the top member, the support member being configured to support the top member at a distance from the base member and adapted to facilitate adjustment of the distance between the base member and the top member.

33 Claims, 8 Drawing Sheets

(56) References Cited

U.S. PATENT DOCUMENTS

| | | | | |
|---|---|---|---|---|
| 2007/0151012 | A1* | 7/2007 | Clark | E03D 11/12 4/420 |
| 2011/0240409 | A1* | 10/2011 | Bacon | B66F 7/065 187/269 |
| 2013/0193392 | A1* | 8/2013 | McGinn | B66F 7/065 254/93 R |
| 2015/0366729 | A1* | 12/2015 | Quick | A61G 5/1059 297/88 |

* cited by examiner

HEIGHT ADJUSTABLE TOILET PLATFORM

CROSS REFERENCE TO RELATED APPLICATIONS

This application claims priority from United Kingdom patent application No. 15 19 623.1 filed Nov. 6, 2015, and from United Kingdom patent application No. 16 18 607.4 filed Nov. 4 2016, the whole contents of which are incorporated herein by reference in their entirety.

BACKGROUND OF THE INVENTION

1. Field of the Invention

The present invention relates to a platform, and in particular, a height adjustable platform suitable for supporting a toilet bowl.

2. Description of the Related Art

Conventionally flushing toilets include a toilet bowl having an upper rim onto which is affixed a hinged top forming a seat base for a user, and a water cistern containing a reservoir of water for flushing purposes forming a seat back. The toilet bowl is typically secured to a floor surface at its base end, with its rear abutted against a wall. A soil pipe exits the rear of the toilet, which is usually routed downwardly through the wall of a building to join a mains sewer.

Toilet bowls tend to be universal in height, with the seat typically being in the region of fifteen inches from floor level. This standard height of the toilet bowl is selected as being the optimal height for use by a majority of users. However, this height can cause problems for certain groups of users, for example, those with physical disabilities, or elderly users with limited mobility, for whom manoeuvring from the standing to the seated position, and vice versa, can be difficult. For such users a relatively taller toilet bowl is desirable to reduce the distance by which they must lower themselves to the seated position, so that they may descend and rise from the sitting position more easily.

It is known in the prior art to provide a toilet seat riser, in the form of a generally U-shaped block with a height that is relatively greater than conventional toilet seat, which is fitted to the upper rim of the toilet bowl thus effectively raising the height of the toilet bowl. Such risers are often constructed of a padded fabrics materials for improved comfort, and can optionally include a hinged lid to allow installation in substitute of the existing toilet seat.

However, a number of problems are experienced with conventional seat riser apparatus. In the first instance, seat risers tend to be offered in a range of standard heights, meaning that a user is restricted to a height that may not be optimal for their condition. Seat risers are available in which the height of the riser, and so the height added to a toilet bowl, is adjustable in use. However, the height is typically adjustable only in discrete increments, for example, in increments of fifty millimeter.

Moreover, such devices incur significant disadvantages both in terms of aesthetic appearance, and in hygiene. In the first instance, the seat riser is above the region of the toilet bowl that is cleaned by the flush of water, and as a result can tend to become contaminated in use. Due in part to problems with maintaining cleanliness, it is common for users of a shared toilet who do not require the additional height, to remove the seat riser before using the toilet, necessitating frequent detachment and refitting of the device, resulting in material fatigue and eventual failure.

In view of the aforementioned limitations to existing devices, it is desirable to provide an alternative means for raising the height of a toilet bowl.

BRIEF SUMMARY OF THE INVENTION

According to a first aspect of the present invention, there is provided a platform for supporting a toilet bowl, the platform comprising a base member for engaging a ground surface; a top member, configured for attachment to a bottom surface of a toilet bowl by attachment means; and a support member, comprising an elongate rod, extending between the base member and the top member, the support member being configured to support the top member at a distance from the base member and adapted to facilitate adjustment of said distance between the top member and the base member.

In an embodiment, the top member comprises a plurality of apertures, capable of receiving attachment means, for attachment to the bottom surface of said toilet bowl.

In a particular embodiment, the apertures define substantially parallel elongate slots, facilitating alignment of said toilet bowl along the length of said top member.

Preferably the support member is adapted to facilitate adjustment of the distance between the base member and the top member.

Preferably the top member is movable relative to the base member between a first position and a second position.

Preferably the support member is adjustable between a first configuration and a second configuration to support the top member in the first the second positions respectively.

Preferably the base member and the top member are axially aligned, and the top member is movable relative to the base member along the axis.

Preferably the support member extends orthogonally between the base member and the top member.

Preferably the attachment means are threaded bolts.

In a particular embodiment, the elongate rod is a threaded rod and defines externally a helical thread extending along at least a portion of the rod. The base member preferably comprises a threaded nut configured to receive the elongate rod.

In an embodiment, the top member defines a substantially planar plate. Preferably, the top member also defines a substantially planar plate.

In a preferred embodiment, the base member and the top member are arranged along parallel planes.

Preferably the platform comprises a plurality of support members extending between the base member and the top member.

Preferably the platform further comprises a motor apparatus operable to adjust the configuration of said support members in a way as to move said top member relative to said base member to vary the distance therebetween.

Preferably said motor apparatus comprises an electric motor.

Preferably said motor apparatus further comprises a helically threaded rod operable to transmit a torque from said electric motor to said support members to adjust the configuration of said support member in a way as to move the top member relative to the base member to vary the distance therebetween.

Preferably said plurality of support members form at least one pair of pivotally coupled support members, the pair of support members being pivotally coupled about a pivot point located between respective ends of each support member.

Preferably each of said support members of said at least one pair is hingedly connected at a first end to either of said base member or said top member, and slidably connected at a second end to either of said base member or said top member.

Preferably said a first support member of said at least one pair is hingedly connected at a first end said base member and slidably connected at a second end to said top member, and a second support member of said pair is hingedly connected at a first end to said top member, and slidably connected at a second end to said base member.

According to another aspect of the present invention, there is provided a kit of parts for assembling a platform for supporting a toilet bowl, the kit of parts comprising a base member for engaging a ground surface; a top member configured for attachment to a bottom surface of a toilet bowl by attachment means; and a support member, comprising an elongate rod, configured to extend between the base member and the top member, further configured to support the top member at a distance from the base member and adapted to facilitate adjustment of said distance between the top member and the base member.

In an embodiment, the top member is adapted to comprise a plurality of apertures, adapted to receive said attachment means, for attachment to the bottom surface of said toilet bowl.

In an embodiment, said apertures define substantially parallel elongate slots, adapted to facilitate alignment of said toilet bowl along the length of said top member.

Preferably the top member is movable relative to the base member between a first position and a second position.

Preferably the support member is adjustable between a first configuration and a second configuration to support the top member in the first and second positions respectively.

According to a further aspect of the present invention, there is provided a toilet having a platform for supporting the toilet bowl, the toilet comprising a base member for engaging a ground surface; a top member, attached to the bottom surface of a toilet bowl by attachment means; and a support member, comprising an elongate rod, extending between the base member and the top member, the support member being configured to support the top member at a distance from the base member and adapted to facilitate adjustment of said distance between the top member and the base member.

In an embodiment, the top member comprises a plurality of apertures, adapted to receive said attachment means, and is attached to the bottom surface of the toilet bowl.

In an embodiment, said apertures define substantially parallel elongate slots, facilitating alignment of said toilet bowl along the length of said top member.

Preferably the top member is movable relative to the base member between a first position and a second position.

Preferably the support member is adjustable between a first configuration and a second configuration to support the top member in the first the second positions respectively.

BRIEF DESCRIPTION OF THE DRAWINGS

In order to better understand the present invention, and to show more clearly how an exemplary embodiment thereof may be carried into effect, reference will now be made, by way of example only, to the accompanying drawings, in which.

DETAILED DESCRIPTION OF EXAMPLE EMBODIMENTS

FIG. 1

Figure 1:
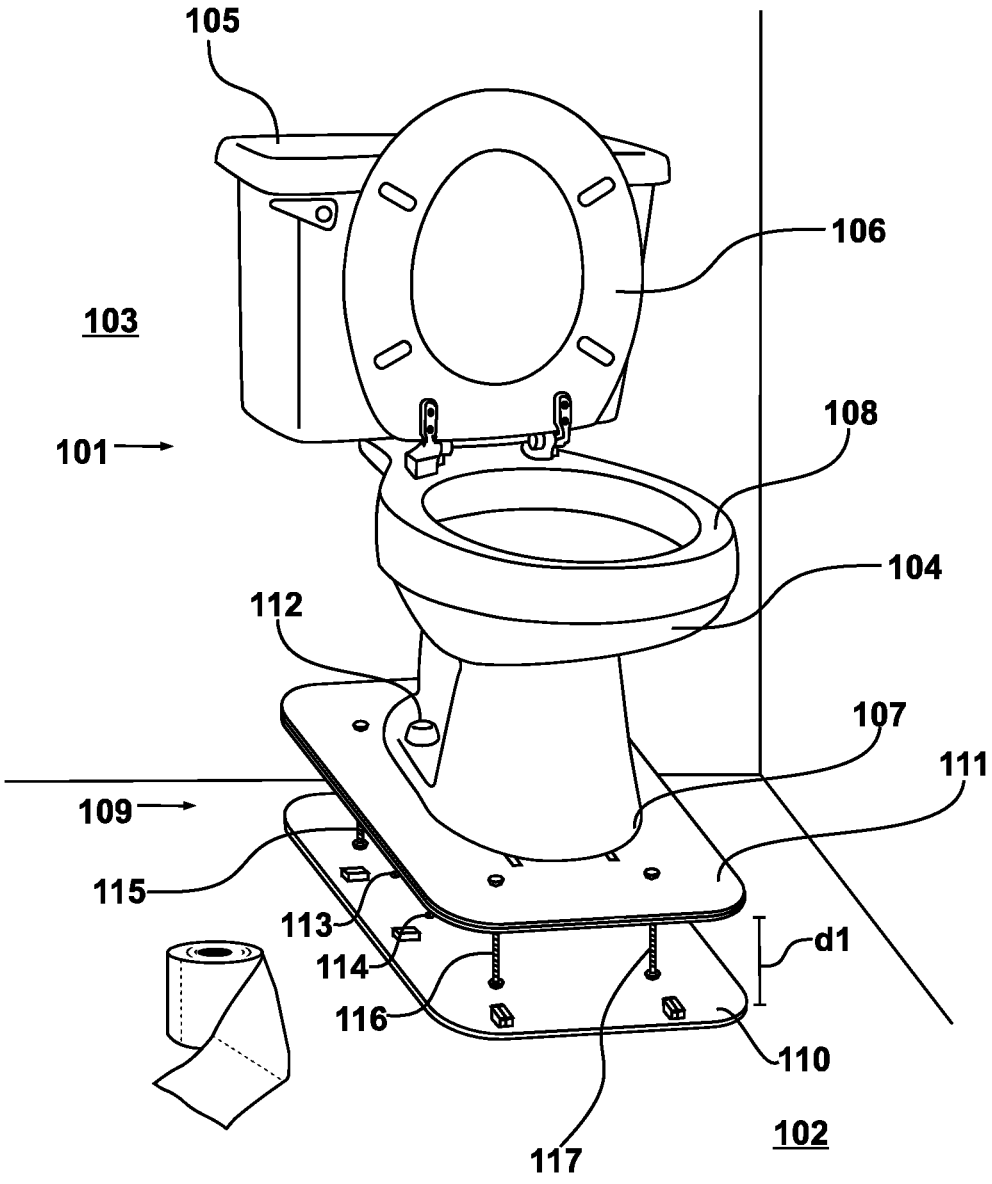
FIG. 1 is an illustration of a toilet including a platform of the present invention.

An example of an environment in which apparatus according to the present invention can be used is shown in FIG. 1, in which a toilet 101 is installed in a domestic bathroom environment, on ground surface 102, with the rear of the toilet abutted against a wall 103.

Toilet 101 comprises generally of a toilet bowl 104, a water cistern 105 containing a reservoir of water for toilet flushing purposes and equipped with an internal flushing mechanism, and a seat top 106, hingedly connected to the toilet bowl, the conventional arrangement of which will be entirely familiar to the skilled person. Toilet bowl 104 defines a substantially bowl shaped stool, extending from a base end 107, upwardly to a generally circular rim 108. As will be understood, the height of the toilet bowl, that being the distance between the base end 107 and the rim 108, is generally selected such that the toilet bowl may function as a seat for a user, who may rest on the rim of the bowl in a squatted position.

Toilet bowl 104 is mounted on a platform 109 according to one embodiment of the present invention, which platform supports the toilet bowl in an elevated position with respect to ground surface 102. Platform 109 comprises of a base member 110, and a top member 111, the top member being adapted for attachment to a bottom surface of the toilet bowl as illustrated. Toilet bowl 104 is attached to the top member 111 by way of attachment means 112, which pass through slots defined in the top member as will be described. Base member 110 is securely attached to the ground surface by way of screws, such as screws 113, 114, which pass through apertures in the base member and engage the ground surface.

Platform 109 further comprises a plurality of support members 115, 116, 117, 118 (support member 118 omitted from view), in the form of elongate rods, positioned generally in each corner of the platform, connected at a first end to the base member 110, and extending generally orthogonally therefrom, upwardly to the top member 111, which support the top member 111 at a distance d1 from the base member. In supporting the top member 111 above the level of ground surface 102, the platform supports the toilet 101 in an elevated position, thus raising the height of the rim 108 of the toilet bowl with respect to the ground surface by a distance d1.

In the specific embodiment illustrated and to be described, platform 109 is configured as a height adjustable platform for supporting a toilet bowl, in which the height of the platform may be adjusted to vary the distance between the base member and the top member, as will be described further with reference to FIGS. 4A & 4B.

As illustrated, in use the platform is secured to the ground surface, and the toilet bowl is placed on the upper surface of the top member 111, and attached thereto. The height of the platform is adjusted to that required by the user, which may be dependent on their height and/or physical mobility, and the toilet is then ready for use. It will of course be appreciated that, particularly where the platform is to be installed on a permanent basis, the platform may be concealed from view by the addition of decorative side and top panels. This may be particularly desirable where the platform is to be installed permanently in a domestic bathroom, where the platform could be boxed in using conventional construction techniques, and carpeted over so as to match the surrounding ground surface.

FIG. 2

Figure 2:
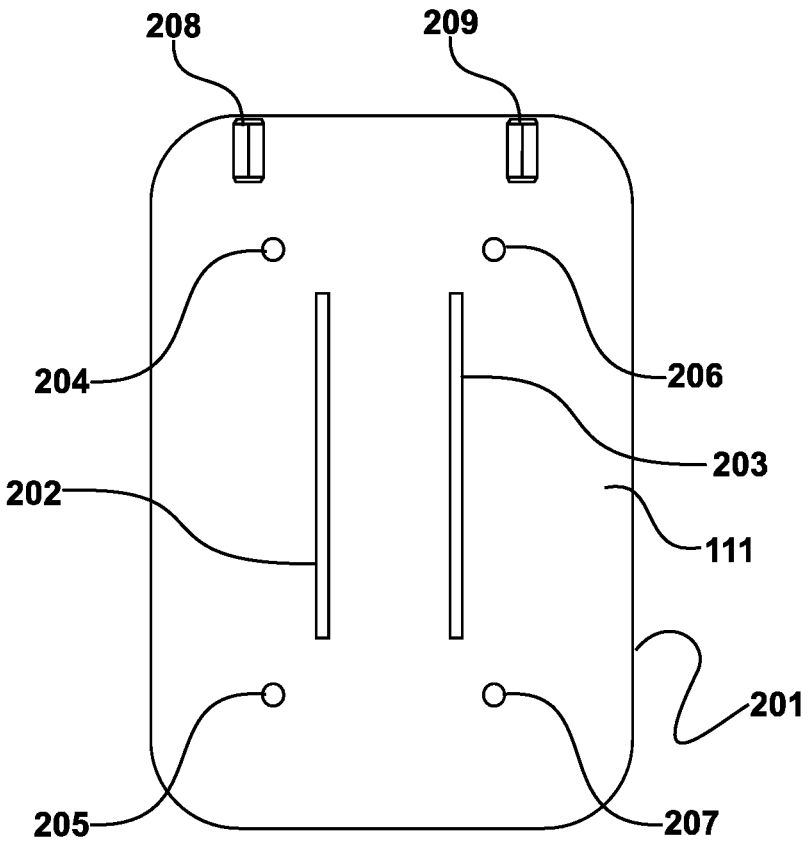
FIG. 2 is an underside plan view of the platform top member.

Top member 111 is shown in an underside plan view in FIG. 2. Top member 111 comprises a substantially planar rectangular plate, constructed of a rigid sheet material, for example, a sheet of mild steel, having a thickness of approximately five millimeters, and length and width dimensions of around four hundred by three hundred millimeters respectively. Top member 111 is configured to have length and width dimensions slightly greater than those of the bottom surface of the toilet bowl, to allow the toilet bowl be mounted on the substantially flat upper surface 201 (not visible) of the top member.

Top member 111 defines a pair of parallel elongate slots 202 and 203, which extend lengthways along a portion of the top member, and penetrate right through the top member to define elongate apertures, each having a diameter of circa ten millimeters. Slots 202, 203 are configured to receive attachment means 112, which in the embodiment are ten millimeter gauge threaded bolts, which are passed through apertures in a flange at the base of the toilet bowl, and extend through the slots in the top member, with a nut and washer being provided to securely attach the toilet bowl to the top member. In this way, by slackening the nuts on the securing bolts, the toilet bowl may be slidably moved along the length of the top member, to allow correct alignment of the toilet to be achieved, for example, to facilitate routing of the soil pipe.

Top member 111 defines apertures 204 to 207, having a diameter of circa twelve millimeters, through which the elongate supporting members 115 to 118 are passed downwardly from the upper surface of the top member, as will be described further with reference to FIGS. 4A and 4B.

Top member 111 is further provided with brackets 208, 209, at the front edge of the underside surface, configured to receive ancillary attachments, for example, a foot rest, to assist a user when using the toilet.

FIG. 3

Figure 3:
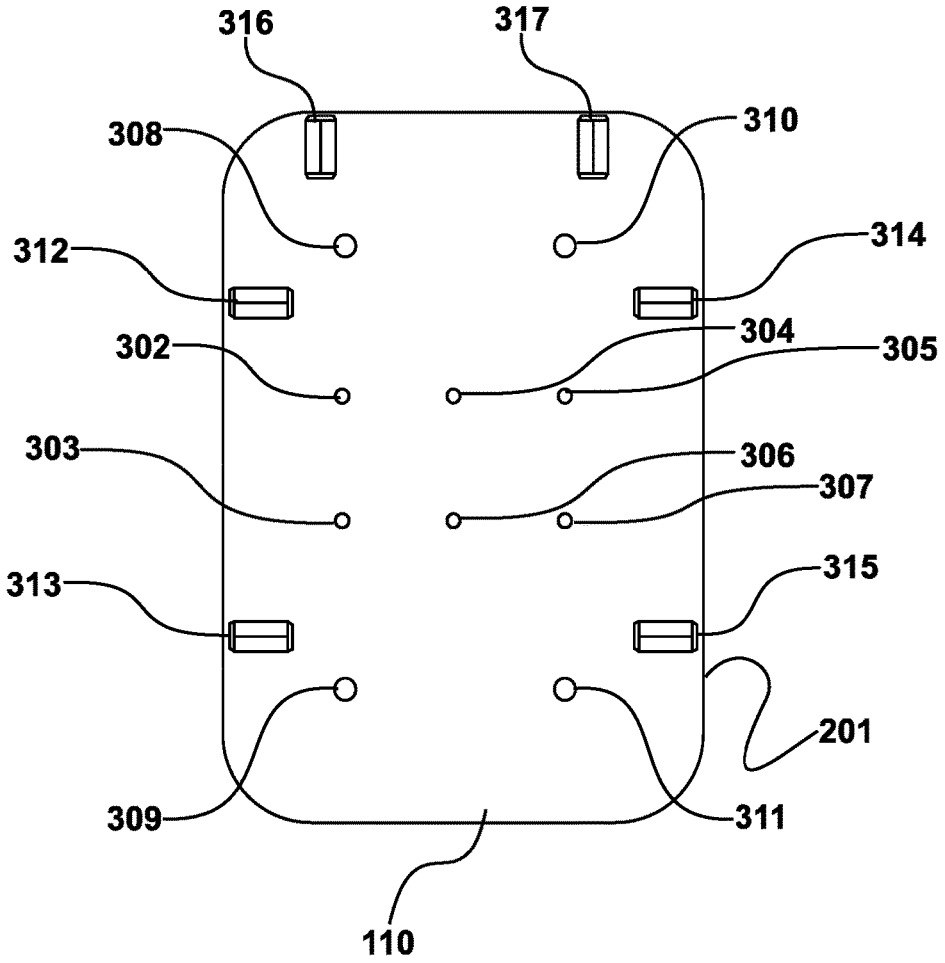
FIG. 3 is a top plan view of the platform base member.

The base member 110 is shown in a top plan view in FIG. 3.

Base member 110 is substantially similar in construction and dimension to the top member 111 described previously with reference to FIG. 2. Base member 110 defines a rigid planar rectangular steel plate, having a substantially smooth lower surface 301 (not visible).

Base member 110 is provided with a plurality of apertures 302, 307, having a diameter of circa eight millimeters. Apertures 302 to 307 are configured for receiving screws, such as screws 113 and 114 described with reference to FIG. 1, used for securing the base member to the ground surface. Base member 110 further defines apertures 308 to 311, having a diameter of around twelve millimeters, through which the elongate supporting members are passed, as will be described further with reference to FIGS. 4A and 4B.

Base member 110 further includes a plurality of brackets, 312 to 317, which are used for securing auxiliary attachments to the base member. In the specific embodiment illustrated, brackets 312 to 315, are provided on the upper surface of the base member adjacent the side edges of the plate, and configured to receive a pair of hand rails (not shown), which extend upwardly from the base member to be approximately level with the height of the rim of the toilet bowl. In a preferred embodiment of the invention, a pair of ambidextrous hand rails are provided as a removable part of the platform, for attachment to the base member, to assist a person with limited mobility in using the toilet. Brackets 316 and 317 are provided at the front edge of the base member for receiving a foot rest attachment, on which a user may rest their feet while using the toilet.

FIGS. 4A & 4B

Figure 4A:
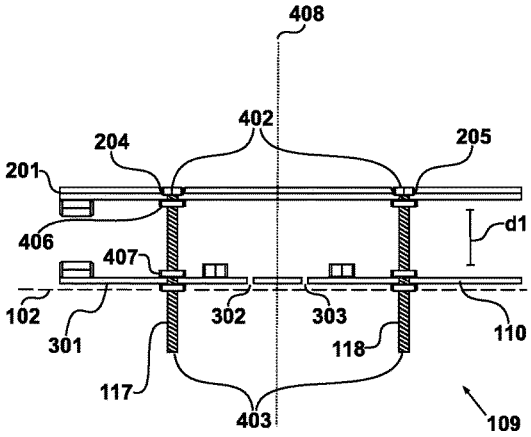
FIG. 4A is a side cross section view of the platform in a first configuration.
Figure 4B:
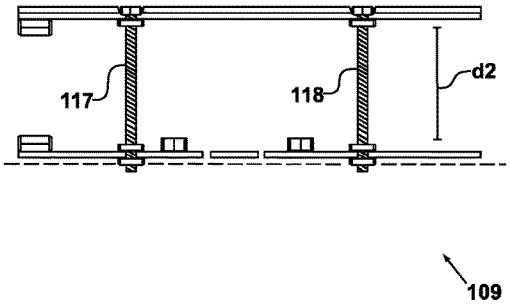
FIG. 4B is a side cross section view of the platform in a second configuration.

The platform apparatus 109 is shown in side cross section views in FIGS. 4A and 4B in lowered and raised states.

Platform 109 is shown in FIG. 4A in a first configuration, in which the top member 111 is in a first position, such that the distance between the base member 110 and the top member 111 is a first distance d1. As described previously with reference to FIG. 1, base member 110 is placed on ground surface 102, with the lower surface 301 of the base member in contact with the ground. Screws 113, 114 are passed through apertures 302 to 307 in the base member, and engage the ground surface, to securely attach the base member to the ground.

Top member 111 is provided above the base member 110, along a plane that is substantially parallel with the plane of the base member. In the embodiment, the top member 111 is further provided with a mat 401, comprised of an elastomeric material, for example, rubber, covering its upper surface 201. Toilet bowl 104 is placed on the top member 111, with its bottom surface in contact with the mat 401 on the upper surface of the top member, and secured to the top member 111 by bolts passing through slots 202, 203, as described previously.

In the specific embodiment, the support members 115 to 118, each comprise an elongate threaded metal rod, with a diameter of around twelve millimeters and having a first end 402 defining a hex head, and a second end 403, and a helical thread extending along the rod between the first and second ends. Support members 115 to 118, are passed through apertures 204 to 207 in the top member 111, and downwardly through apertures 308, 311 in the base member. In the embodiment, base member 110 further comprises a weld nut 404, 405, welded to the lower surface of the base member adjacent each said aperture 308 to 311. Thus, the distal end of each said elongate support member is passed through its respective aperture 308 to 311, in the base member 110, and threaded through the weld nut 404, 405. Said elongate support members 115, 118 each further comprise a pair of hex nuts, such as hex nuts 406 and 407, interposed along the length of the rod between said first and second ends.

Platform 109, is shown in a first configuration in FIG. 4A, in which the top member is in a first position with respect to the base member, and the distance d1 between the base member and the top member is in the region of fifty millimeters. In this configuration, the platform will serve to elevate a toilet attached to the top member by the same distance. In the specific embodiment however, the platform is adjustable in height, and support members 115 to 118 are configured to facilitate adjustment of the distance between the base member 110 and the top member 111, to thereby increase, or decrease, the height of the platform and raise or lower the toilet. Thus, the top member is configured to be movable relative to the base member, between the first position shown in FIG. 4A, in which the distance between the upper surface of the base member and the lower surface of the top member is d1, and the second position shown in FIG. 4B, in which the distance there between is d2, thus increasing the height of the platform.

In the embodiment, the distance between the plates d2 is in the region of four hundred millimeters, and thus the platform 109 is adjustable in height between fifty millimeters and four hundred millimeters. It will of course be appreciated however, that in alternative embodiments, the platform may be adjustable in height over a greater range, for example, from ten millimeters to one thousand millimeters, depending on the environment in which it is to be used.

The base member and the top member are axially aligned along the axis 408 which extends orthogonally through the centre point of said base and top members, that is to say the top member is directly above the base member, and the top member is movable along said axis, upwardly and downwardly generally vertically relative to said ground surface.

Support members 115 to 118 are adjustable, by way of rotating the elongate rods 115, 118 with respect to the weld nuts 404, 405, and by repositioning the nuts 406, 407, so as to increase or decrease the distance between the base member and the top member. In the embodiment, the elongate threaded rods are passed downwardly through the top member and the base member of the platform, with the hex head 402 resting against the upper surface of the top member. In this way, the hex head remains accessible even once the platform and toilet are installed as described, allowing further height adjustment.

FIG. 5

Figure 5:
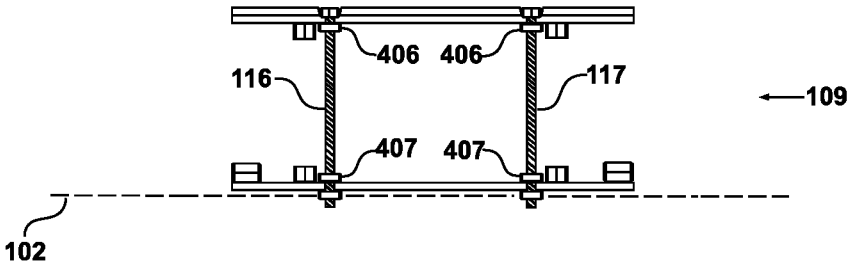
FIG. 5 is an end cross section view of the platform in the second configuration.

The platform apparatus 109 is shown in an end cross section view in FIG. 5, in the second position, illustrated previously in side view in FIG. 4B.

As has been described, the plurality of support members 115 to 118 support the top member at a distance from the base member, and may be adjusted to increase or decrease the distance between the base member and the top member, and thereby vary the height of the platform. In the specific embodiment of the invention illustrated, the platform is provided with a plurality of support members, in the form of elongate threaded rods, positioned generally at each corner of the platform.

The distance between the base member and the top member is adjusted by rotating the threaded rods relative to the hex nuts, which hold the base member and the top member in position along the length of the rod. In this way, as each threaded rod is rotated clockwise, the rod is drawn downwardly through the weld nut positioned on the lower surface of the base member, thus lowering the top member with respect to the base member. The second end of the elongate threaded rods are lowered into cavities formed for this purpose in the ground surface. Once all four support members are adjusted to the required height, and such that the top member is level relative to the ground surface, the nuts 406, 407 of the support members, may be adjusted so as to securely clamp against the lower and upper surface of the top and base members respectively, thereby creating a stable structure for supporting the toilet.

FIGS. 6A & 6B

A second platform 601 according to a second embodiment of the present invention will now be described with reference to FIGS. 6 to 8.

Figure 6A:
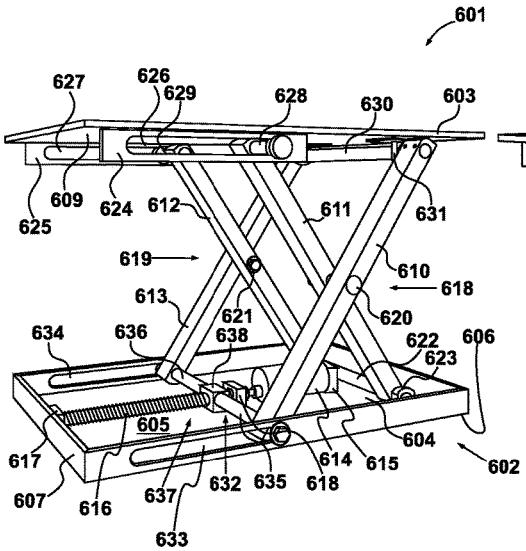
FIGS. 6A and 6B show in different perspective views a second platform according to an aspect of the present invention.
Figure 6B:
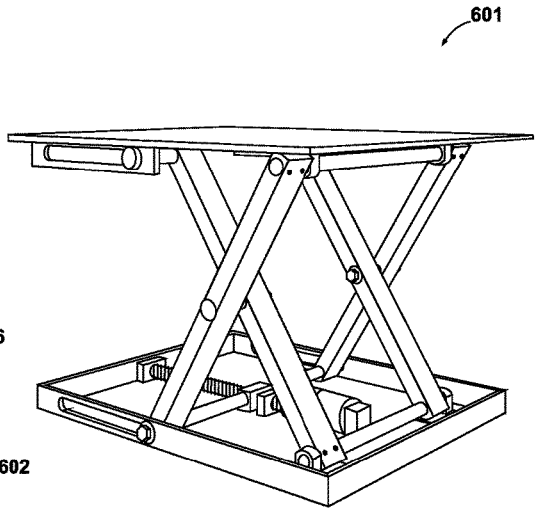

Referring particularly to FIGS. 6A and 6B, platform 601 comprises a base member 602, and a top member 603. As illustrated, said base member 602 comprises principally of a generally planar sheet portion 604 having upper and lower surfaces 605, 606, and a peripheral wall portion 607 upstanding from adjacent the peripheral edges of said sheet portion 604. Said top member 603 comprises principally of a generally planar sheet having upper and lower surfaces 608, 609. The platform 601 is shown in FIGS. 6A and 6B in a configuration in which the distance between the top member 603 and the bottom member 602 is at maximum, i.e. in a raised position with respect to a ground surface on which the platform may be mounted.

Similarly to the platform 109 described with reference to FIGS. 1 to 5, top member 603 is configured for attachment to a bottom surface of a toilet bowl, for example, by positioning the toilet bowl on the top surface 608 of said top member 603, and securing the toilet bowl to the top member by any suitable means, for example, by adhesive, or nut and bolts. Further, said base member 602 is configured for attachment to a ground surface by positioning the base member on the ground surface with its lower surface 606 in contact with the ground surface, and securing the base member to the ground surface using similar suitable attachment means.

In a similar manner to platform 109, platform 601 further comprises a plurality of (substantially like) support members 610, 611, 612, 613, extending between the base member 602 and the top member 603, the plurality of support members being configured to support the top member 603 at a distance from the base member 602.

As will be described further with reference to FIGS. 6 to 8, the principal difference between said platform 109 and said platform 601, aside from the different operation of support members 610 to 613, is that said platform 601 comprises a motor apparatus (indicated generally at 637) operable to adjust the configuration of the support members 610 to 613 in a way as to move the top member 603 relative to the base member 602 to vary the distance therebetween. In the embodiment, motor apparatus 637 comprises electric motor 614 with mounting bracket 615, and threaded rod 616 carried by brackets 617, 618. Motor apparatus 637 will be described in further detail with reference to FIGS. 8A and 8B.

Said platform 601 comprises a plurality of support members, in the specific embodiment, four substantially like support members 610 to 613. The plurality of support members are arranged in two pairs, said first pair 618 comprising support members 610 and 611, and said second pair 619 comprising support member 612 and 613, the support members in each pair being pivotally coupled about a pivot point 620, 621 positioned between the respective ends of the support members. In the particular embodiment, the pivot point 620, 621 is located approximately equidistant between the respective ends of each support member. In the embodiment, said coupled pairs of support members 618, 619 are mutually connected, such that the pairs together support the top member 603 with respect to the base member 602. Thus, as illustrated, a first support member in each said pair 618, 619, in this case said support members 611, 613 are each rigidly coupled adjacent a respective lower end to shaft 622. The outer ends of said shaft 622 are rotatably received by like brackets 623, which brackets 623 each include a rolling bearing element configured to engage the respective outer end of the shaft 622 allowing the shaft 622 to rotate relative to brackets 623. Brackets 623 are in turn each rigidly mounted to the top surface 605 of said bottom member 602.

The upper ends of each support member 611, 612 are slidably coupled to said top member. In the embodiment, said top member 603 comprises brackets 624, 625 extending downwardly from the bottom surface 609 of the top member 603. Each said bracket 624, 625 defines an elongate slot 626, 627 within which a stub axle 628, 629 protruding from adjacent the upper end of each support member 611, 612 is received. In this way, the stub axles 628, 629 are free to move along the slots between its ends.

In a similar way, a second support member in each said pair 618, 619, in this case support members 610, 613, are each rigidly coupled adjacent a respective upper end to shaft 630. Similarly, the outer ends of said shaft 630 are rotatable received by like brackets 631 which brackets 631 each include a rolling bearing element configured to engage the respective outer end of the shaft 630 allowing the shaft 630 to rotate relative to brackets 631. Brackets 631 are in turn each rigidly mounted to the bottom surface 609 of said top member 603.

The lower ends of each support member 610, 613 are each rotatably coupled to shaft 632 adjacent respective outer ends of the shaft. The outer ends of shaft 632 are then slidably received in elongate slots 633, 634, substantially identical to elongate slots 626, 627, in said upwardly extending side wall 607. In this way, the shaft 632 is free to move along the slots 633 634. In the specific embodiment, said shaft 632 is in actuality comprised of two separate shaft halves, first half 635 and second half 636. Said first and second halves 636, 637, are rigidly coupled by way of coupling block 638.

Thus, it will be appreciated that the operation of said pairs of coupled support members 618, 619 is scissor-like, to thereby allow adjustment of the distance between the base member 602, and the top member 603.

FIGS. 7A & 7B

The platform 601 previously described with reference to FIGS. 6A and 6B is shown in side elevation views in FIGS. 7A and 7B.

Figure 7A:
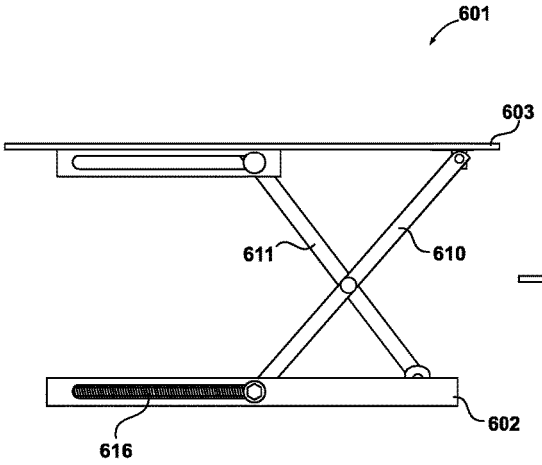
FIGS. 7A and 7B show the platform identified in FIGS. 6A and 6B in side elevation views in first and second configurations respectively.

In FIG. 7A the platform is shown in the extended configuration previously illustrated in FIGS. 6A and 6B, in which the top member 603 is raised above the base member 602 at a maximum height, i.e. the vertical distance between the base member 602 and the top member 603 is at a maximum.

Figure 7B:
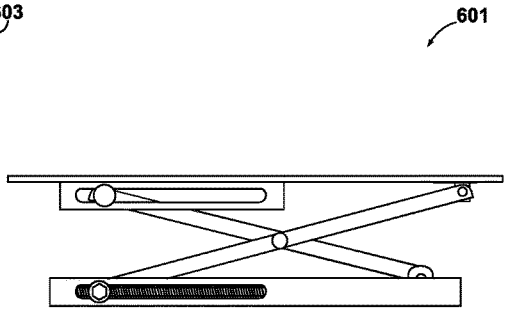

In FIG. 7B the platform is shown in a collapsed configuration in which the vertical distance between the base member 602 and the top member 603 is reduced towards a minimum separation.

FIGS. 8A & 8B

Figure 8A:
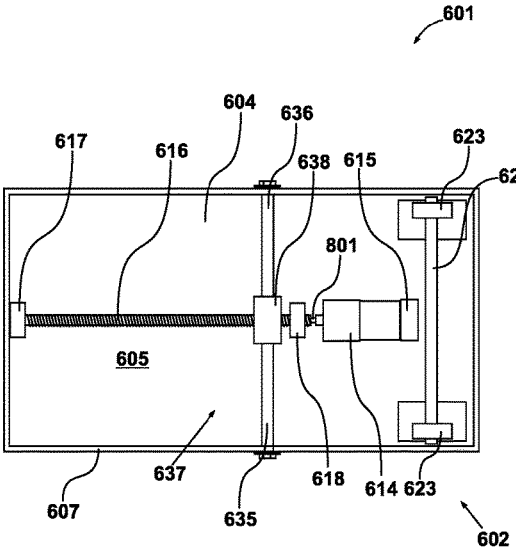
FIGS. 8A and 8B are top plan views of parts of the platform of FIGS. 6A, 6B, 7A and 7B in the first and second configurations.
Figure 8B:
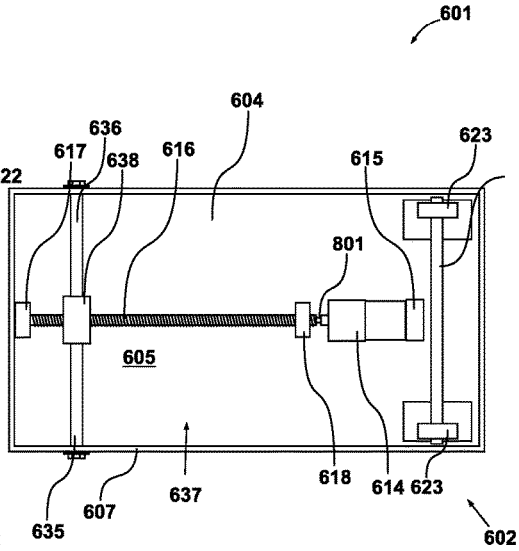

FIGS. 8A and 8B are top plan views of the base member 602 in the extended and collapsed conditions respectively. In the figures a number of the components of the platform 601 are omitted to improve clarity. In particular, the top member 603, and support members 610 to 613 are omitted from view.

Referring to the Figures, said platform 601 is provided with motor apparatus (indicated generally at 637) configured to adjust the configuration of the support members 610 to 613 to thereby vary the distance between the base member 602 and the top member 603. In the embodiment, motor apparatus 637 comprises an electric motor 614 rigidly mounted to the upper surface 605 of the base member 602 by way of fixing bracket 615.

As illustrated, motor apparatus 637 further comprises threaded rod 616, which rod defines externally a continuous helical thread extending the length of rod. Said rod 616 is mounted to the upper surface 605 of said base member 602 by way of brackets 617, 618, which brackets are equipped with a rolling bearing element configured to engage the rod 616 to allow rotation of the rod 616 relative to the brackets 617, 618, and base member 602. Rod 616 is rotatably coupled to an output shaft 801 of said electric motor.

As illustrated, rod 616 passes through a cylindrical hole defined through said coupling block 638 coupling the two halves 635, 636 of the shaft 632. The cylindrical internal surface of the coupling block 638 defines a helical thread corresponding to the helical thread of said rod 616. Thus, as will be understood, rotation of said threaded rod 616 relative to said coupling block 638 within said threaded hole results in axial movement of the rod 616 relative to the block 638 in a direction dictated by the direction of rotation of the rod 616. Given that axial movement of said threaded rod 616 is prevented by brackets 617, 618, rotation of said rod 616 causes said coupling block 638 to be wound along the rod 616 resulting in linear movement of the block 638.

Thus referring particularly to FIG. 8A, the motor apparatus 637 is shown in a first configuration, in which the coupling block 638 and shaft 632 are located on towards the end of the rod 616 proximal the electric motor 614. It will be understood that in this position the shaft 632 retains the lower ends of support members 611, 613 at a first end of the elongate slots 633, 634, closest to the lower ends of the support members 611, 612. In this configuration, the top member 603 is supported above the base member 602 at the maximum height shown in FIG. 7A.

Referring secondly to FIG. 8B, in this configuration electric motor apparatus 614 has been operated to apply a torque to said threaded rod 616 thereby causing the rod 616 to rotate. In the condition shown in FIG. 8B, the electric motor 614 has rotated rod 616 to cause said coupling block 638 to be wound almost to the opposite end of the rod 616.

As will be appreciated, movement of said coupling block 638 causes said shaft 632 to slide along said elongate slots 633, 634, in a direction generally away from the electric motor 614. Movement of the shaft 632 in turn causes the lower ends of said support members 610, 613, to be moved away from the lower ends of the support member 611, 612. As will be evident, movement of the lower ends of the support members 610, 613 away from the lower ends of the support members 611, 612, causes the pair of pivotally coupled support members to fold, thereby reducing the distance between the top member 603 and the base member 602. Thus, the configuration of motor apparatus 637 shown in FIG. 8B corresponds to the configuration of the platform shown in FIG. 7B in which the platform is in a collapsed condition with the top member supported above the base member at a near minimum height.

It will be understood that the embodiment of the present invention described with reference to FIGS. 6 to 8 is advantageously adjustable in height by way of operation of said motor apparatus 637. Provision of said motor apparatus 637 thus allows easier adjustment of the height of the platform 601, that is the distance between the base member 603 and the top member 602, than is possible with platform 109 which requires manual operation. It will of course be appreciated that motor apparatus 637 may further be equipped with control equipment, for example, an electrical controller to control the operation of said electric motor 614.

Whilst two specific embodiments of the invention have been described herein, it will of course be appreciated that a number of alternative suitable arrangements exist. In particular, it will be appreciated that various alternative types of support members are suitable for supporting the top member at a set distance from the base member. Indeed, in an alternative embodiment, the support members may comprise a plurality of hydraulic rams extending between the base member and the top member, which support the top member, and the length of which may be readily adjusted to vary the distance between the base member and the top member. In particular embodiments, the support members could be configured to support the top members in set positions, to allow adjustment of the distance between the top member and the base member in discrete increments. As an alternative, the support member may be configured to allow linear adjustment of the distance between the base member and the top member. In a further alternative embodiment, the platform is provided with only a single support member, which may for example be in the form of a central pillar extending between the base member and the top member.

Further, it will be appreciated that the arrangement of the support members 610 to 613 of platform 601 described with reference to FIGS. 6 to 8, could equally be incorporated into the platform 109 described with reference to FIGS. 1 to 5. That is to say, the platform 109 could, in substitute of threaded support members 610 to 613, be provided with pivotally connected support members, such as support members 610 to 613, connected to the top member and base member 115 to 118 in the way described with reference to FIGS. 6 to 8.

Moreover, considering the configuration of platform 601 described with reference to FIGS. 6 to 8, it will be appreciated that said electric motor 614 may alternatively be replaced by, for example, a hydraulic motor or pneumatic motor. Indeed, in alternative embodiments, said motor apparatus 637 may not comprise a rotary motor producing rotational movement and a threaded rod to convert that rotational movement into linear movement, rather the motor 614 and rod 616 could be replaced by a linear motor, such as a linear electric motor, or even a hydraulic ram, configured to allow the configuration of the support members to be adjusted to raise or lower the top member 603 relative to the base member 602.

It will however be appreciated that the arrangement of motor apparatus 637 described with reference to FIGS. 6 to 8 is configured advantageous over alternatives, for example, a hydraulic ram directly adjusting the configuration of the support members, inasmuch that the use of the threaded rod 616 to convert a torque from electric motor 614 into motion of shaft 632 is 'failsafe' in operation. As will be understood, rotation of said rod 616 about its axis by a torque from electric motor 614 will usually cause linear movement of said block 638 along the axis of the rod 616. However, the converse is not necessarily true. That is to say, a force exerted on said block 638 parallel to the axis of the rod 616, will not necessarily cause rotation of the rod 616, because of frictional resistance between the threads of the rod 616 and the threads defined by the hold through block 638.

Thus, in the configuration described with reference to FIGS. 6 to 8, even if electric motor 614 were to fail in some way, it will be understood that the block 638 will likely remain in a fixed position along rod 616, resisting any forces exerted on it parallel to the axis of the rod, and so will continue to support the top member 603 in the set position, rather than allowing the top member 603 to move downwardly towards the base member 602 as might occur in the event of failure of, for example, a hydraulic ram arrangement.

Furthermore, it is envisaged that the present invention may be provided as a kit of disassembled parts, as clearly assembly and adjustment is required in installing the product and mounting the toilet bowl. Thus, the present invention provides a kit of parts for assembling the platform used for supporting a toilet, described previously with reference to FIGS. 1 to 5, which includes, as unassembled components, the base member, the top member, and the one or more support members. The support members may then be connected to, and arranged to extend between, the base member and the top member during assembly.

Moreover, in a further embodiment of the invention, a toilet may be provided already equipped with the platform described herein, in which the top member is attached to the toilet bowl, for example, to a bottom surface of the toilet bowl, with the base member and the support members already assembled, such that the base member may be secured to a ground surface, and the support members may be then adjusted to set the distance between the base member and the top member to the required height.

What we claim is:

1. A platform for supporting a toilet bowl, said toilet bowl having a bottom surface, the platform comprising:

a base member for engaging a ground surface;

a top member, configured for attachment to said bottom surface of the toilet bowl by attachment means; and a support member, comprising an elongate rod, extending between the base member and the top member, the support member being configured to support the top member at a distance from said base member and adapted to facilitate adjustment of said distance between the top member and the base member.

2. The platform of claim 1, in which said top member is movable relative to said base member.

3. The platform of claim 1, in which said top member is movable relative to said base member between a first position and a second position.

4. The platform of claim 3, in which said support member is adjustable between a first configuration and a second configuration to support said top member in said first and second positions respectively.

5. The platform of claim 1, in which said base member and said top member are axially aligned, and said top member is movable relative to said base member along said axis.

6. The platform of claim 1, in which said support member extends orthogonally between said base member and said top member.

7. The platform of claim 1, in which said elongate rod defines externally a helical thread extending along a portion of said rod.

8. The platform of claim 7, in which said base member further comprises a threaded nut configured to receive said elongate rod.

9. The platform of claim 1, in which said top member defines a substantially planar plate.

10. The platform of claim 1, in which said base member defines a substantially planar plate.

11. The platform of claim 1, in which said base member and said top member are arranged along parallel planes.

12. The platform of claim 1, comprising a plurality of said support members extending between said base member and said top member.

13. The platform of claim 12, further comprising a motor apparatus operable to adjust the configuration of said support members in a way as to move said top member relative to said base member to vary the distance therebetween.

14. The platform of claim 13, in which said motor apparatus comprises an electric motor.

15. The platform of claim 14, in which said motor apparatus further comprises a helically threaded rod operable to transmit a torque from said electric motor to said support members to adjust the configuration of said support member in a way as to move the top member relative to the base member to vary the distance therebetween.

16. The platform of claim 12, in which said plurality of support members form at least one pair of pivotally coupled support members, the pair of support members being pivotally coupled about a pivot point located between respective ends of each support member.

17. The platform of claim 16, in which each of said support members of said at least one pair is hingedly connected at a first end to either of said base member or said top member, and slidably connected at a second end to either of said base member or said top member.

18. The platform of claim 16, in which said a first support member of said at least one pair is hingedly connected at a first end said base member and slidably connected at a second end to said top member, and a second support member of said pair is hingedly connected at a first end to said top member, and slidably connected at a second end to said base member.

19. A kit of parts for assembling a platform for supporting a toilet bowl, said toilet bowl having a bottom surface, the kit comprising:

a base member for engaging a ground surface;

a top member configured for attachment to said bottom surface of the toilet bowl by attachment means; and a support member, comprising an elongate rod, configured to extend between the base member and the top member, further configured to support the top member a distance from said base member and adapted to facilitate adjustment of said distance between the top member and the base member.

20. The kit of parts of claim 19, in which said top member is configured to be movable relative to said base member.

21. The kit of parts of claim 19, in which said top member is configured to be movable relative to said base member between a first position and a second position.

22. The kit of parts of claim 21, in which said support member is adjustable between a first configuration and a second configuration to support said top member in said first and second positions respectively.

23. A toilet, comprising a toilet bowl with a bottom surface and having a platform for supporting said toilet bowl, the toilet comprising:

a base member for engaging a ground surface;

a top member attached to said bottom surface of the toilet bowl by attachment means; and a support member, comprising an elongate rod, extending between the base member and the top member, the support member being configured to support the top member at a distance from said base member and adapted to facilitate adjustment of said distance between the top member and the base member.

24. The toilet of claim 23, in which said top member is movable relative to said base member.

25. The toilet of claim 23, in which said top member is movable relative to said base member between a first position and a second position.

26. The toilet of claim 25, in which said support member is adjustable between a first configuration and a second configuration to support said top member in said first and second positions respectively.

27. The platform of claim 1, in which said top member comprises a plurality of apertures, adapted to receive said attachment means, for attachment to the bottom surface of said toilet bowl.

28. The platform of claim 27, in which said plurality of apertures define a plurality of substantially parallel elongate slots, facilitating alignment of said toilet bowl along the length of said top member.

29. The platform of claim 1, in which said attachment means comprise threaded bolts.

30. The kit of parts of claim 19, in which said top member is adapted to comprise a plurality of apertures, adapted to receive said attachment means, for attachment to the bottom surface of said toilet bowl.

31. The kit of parts of claim 30, in which said plurality of apertures define substantially parallel elongate slots, adapted to facilitate alignment of said toilet bowl along the length of said top member.

32. The toilet of claim 23, in which said top member comprises a plurality of apertures, adapted to receive said attachment means, and is attached to the bottom surface of said toilet bowl.

33. The toilet of claim 32, in which said apertures define substantially parallel elongate slots, facilitating alignment of said toilet bowl along the length of said top member.

* * * * *